United States Patent [19]

Yoshizawa

[11] 4,383,852

[45] May 17, 1983

[54] PROCESS FOR PRODUCING FINE POWDERY METAL

[75] Inventor: Akinori Yoshizawa, Nakano Daini Koupo 1102, 24-16, Nakano 5-Chome, Nakano-Ku, Tokyo-To, Japan

[73] Assignees: Toho Aen Kabushiki Kaisha; Akinori Yoshizawa, both of Tokyo, Japan

[21] Appl. No.: 354,864

[22] Filed: Mar. 4, 1982

[30] Foreign Application Priority Data

Sep. 13, 1980 [JP] Japan ..... 55/127415

[51] Int. Cl.[3] ..... B22F 9/12

[52] U.S. Cl. ..... 75/0.5 B; 75/0.5 BA; 75/0.5 BB; 427/216; 427/220

[58] Field of Search ..... 75/0.5 B, 0.5 BA, 0.5 BB, 75/0.5 BC; 427/216, 220

[56] References Cited

U.S. PATENT DOCUMENTS

| | | | |
|---|---|---|---|
| 2,663,633 | 12/1953 | Crowley et al. | 75/0.5 BA |
| 2,673,797 | 3/1954 | Whitehouse et al. | 75/0.5 BA |
| 2,762,700 | 9/1956 | Brooks | 75/0.5 BA |
| 3,671,220 | 6/1972 | Jonsson | 75/0.5 B |
| 4,140,528 | 2/1979 | Hebeisen et al. | 148/11.5 N |

OTHER PUBLICATIONS

"Formation of Fine Silicon Carbide Powders by a Vapor Phase Method" Y. Okabe, J. Hojo and A. Kato, Department of Applied Chemistry, Faculty of Engineering, Kyushu University, Journal of the Less-Common Metals, vol. 68, pp. 29–41 (1979).

"$TiO_2$ Produced by Vapor-Phase Oxygenolysis of $TiCl_4$", Y. Suyama and A. Kato, Department of Applied Chemistry, Faculty of Engineering, Kyushu University.

Journal of the American Ceramic Society, vol. 59, No. 3–4, pp. 146–149 (1976).

"Flame Structure" Chapter II, pp. 9–42, R. M. Fristrom and A. A. Westenberg, The Applied Physics Laboratory, The Johns Hopkins University, McGraw-Hill Book Company, 1965, Printed in U.S.A.

"Boundary Layer Theory" 7-th Edition, Chapter XXIV, pp. 729–757, Hermann Schlichting (translated by J. Kestin), McGraw-Hill, Inc. 1979 printed in U.S.A.

*Primary Examiner*—W. Stallard

*Attorney, Agent, or Firm*—Ladas & Parry

[57] ABSTRACT

In a generally elongated reaction tube at an elevated temperature, a reducing gas stream is caused to flow along the axis of the reaction tube and a metal-halide gas stream diluted with an inert carrier gas is caused to flow in the same direction as but at a different velocity relative to the reducing gas stream. The two gas streams contact each other in a laminar manner and form an unstable interface region therebetween wherein the metal halide gas is reduced to form fine metal particles with uniform particle size.

10 Claims, 2 Drawing Figures

PROCESS FOR PRODUCING FINE POWDERY METAL

BACKGROUND OF THE INVENTION

This invention relates to a process for production of fine powdery metal. More particularly, it relates to a process for production of fine powdery metallic materials of a high purity such as single-metal particles, particles of solid solution-type alloys, alloy particles the surfaces of which have been coated with another metal, and metal particles having plastic coating thereon.

As a metallurgical method for obtaining fine powdery metal, reduction metallurgy has hitherto been known. This method comprises reducing metallic materials existing in the form of oxides, chlorides, fluorides and the like with a reducing agent such as magnesium and calcium to obtain solid metal powder. This method is typically represented by a process for production of beryllium powder by reducing beryllium fluoride with magnesium and a process for production of vanadium powder by reducing vanadium oxide with calcium. This method, however, is applicable to only the production of metals having a high melting point and also cannot be applied to the production of alloys. Furthermore, there are other problems such as an upper limit to the purity of the fine powdery metal obtained and the tendency of the particle size to become ununiform.

In addition to the above mentioned method, a spray method has been known as a method for obtaining fine powdery metals such as zinc. This method comprises dividing molten metal finely by spraying it with a pressurized gas to obtain metal powder. This method only divides molten metal finely and cannot control the composition of the metal. Moreover, in accordance with this method, the shapes of the resulting fine particles are not uniform, the particle size is not constant, and the fineness thereof is limited to an order of several tens of microns.

Furthermore, methods utilizing laser induced chemical reaction, metal evaporation in low pressure inert gas and supersonic condensation, are known to produce fine powdery metals.

SUMMARY OF THE INVENTION

It is an object of the present invention to provide a process for production of fine powdery metal via gas-phase reduction. A more particular object of the present invention is to provide a process for production of fine powdery metal which comprises contacting a metal halide gas stream and a reducing gas stream in a laminar manner and causing the two gas streams to react in an interface region between the gas streams.

In accordance with the present invention, there is provided: a process for producing fine powdery metal which comprises, in a generally elongated reaction tube at an elevated temperature, causing a reducing gas stream to flow along the axis of the reaction tube, and causing a mixture gas stream comprising a metal halide vapor and an inert carrier gas to flow in the same direction as but at a different velocity relative to the reducing gas stream so that the two streams contact each other in a laminar manner and form an unstable interface region therebetween, whereby the metal halide vapor is reduced by the reducing gas to form fine metal particles in the unstable interface region.

In the process described above, because of the difference in velocity and specific gravity between the metal halide gas stream and the reducing gas stream which contact each other in a laminar manner, there is formed an unstable interface region (an interface layer in which small vortices or eddies are produced continuously, and the continuous vortices gather together) at the boundaries between the two gases, whereby fine powdery metal is obtained by the growth of metal nuclei produced by the reduction of the metal halide in the unstable interface region.

DETAILED DESCRIPTION OF THE INVENTION

Figure 1:
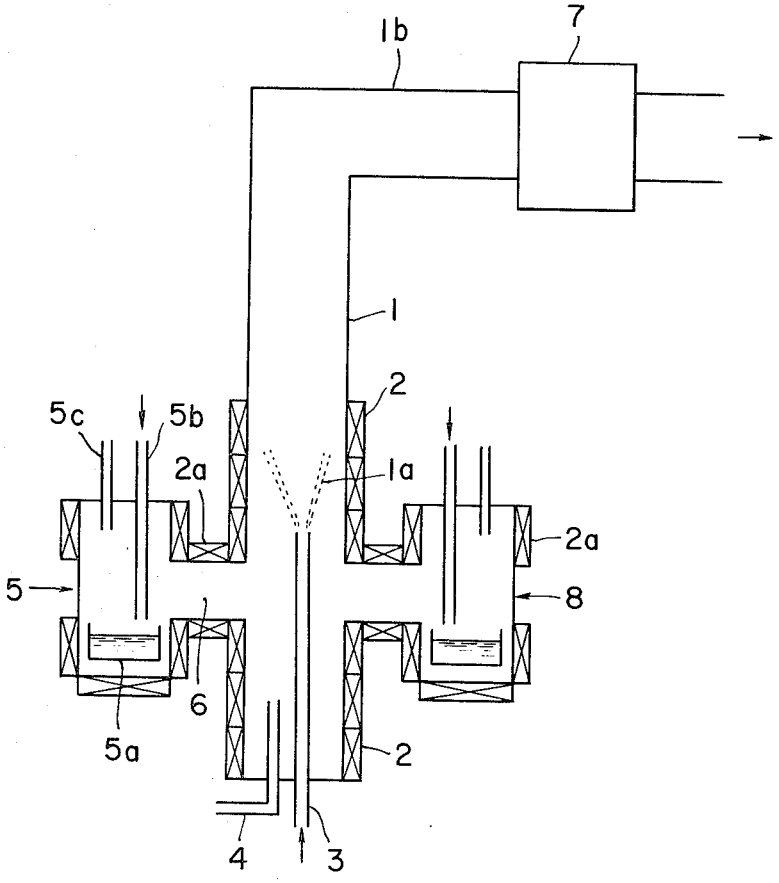
FIGS. 1 and 2 are schematic views respectively showing examples of the apparatus for carrying out the processes of the present invention.

The present invention will now be described in detail with respect to the apparatuses illustrated in the attached drawings. FIG. 1 is a schematic view showing an example of the structure of the apparatus for the use in the practice of the present invention. In the example of this apparatus, a vertical reaction tube 1 is employed for flow of both the reducing gas and the material gas upward to grow the metal particles. At the lower portion of the vertical reaction tube 1, installed within a heater 2, a supply tube 3 is adapted to introduce a reducing gas stream into the reaction tube. The supply tube 3 extends into the interior of the reaction tube and has an upper end opening for injecting the reducing gas upward into the reaction tube 1. Ordinarily, $H_2$ gas is used as the reducing gas, and the supply tube 3 is communicated with an outside $H_2$ gas supply device (not shown). An inert gas-supply tube 4 may be installed together with the supply tube 3 at the lower portion of the reaction tube 1, whereby reverse flow of the $H_2$ gas is prevented by the flow of the inert gas.

On the other hand, a metal halide gas supply device 5 is installed outside of the vertical reaction tube 1. A metal halide has supply tube 6 for introducing the metal halide gas into the vertical reaction tube 1 has an opening near and below the opening of the reducing gas supply tube, whereby the metal halide gas and the reducing gas contact each other in a laminar manner. The metal halide gas supply device 5 is provided with a reservoir **5*a* for a molten metal halide and a carrier gas supply tube 5*b*. The supply tube 5*b* has an opening immediately above the reservoir 5*a* so that the quantity of the vaporized metal halide can be controlled by injecting the carrier gas. Furthermore, a replenishing tube 5*c* is provided for replenishing the molten metal halide. A metal halide gas supply device 8 has substantially the same structure as the device 5** and may be used, according to necessity, as a source of the same or a different metal halide for the production of alloy particles as will be explained hereinafter.

Inside of the vertical reaction tube 1 and above the reducing gas supply tube 3 and the metal halide gas supply tube 6 is formed a reaction zone where the two gas streams flow in a laminar manner and form an unstable interface region **1*a* wherein the nuclei of fine particles are produced. The zone for producing the nuclei is finally connected with a collector 7** for collecting the resulting fine powder.

The metal halide gas supply device 5 and the metal halide gas supply tube 6 are accommodated in a furnace 2a, similarly as the reaction tube 1, or they are thermally insulated.

Metal chlorides are generally used as material metal halides.

Fine powdery metal is produced by means of the above-described apparatus in the following manner.

The reducing gas is fed upwards through the supply tube 3 into the reaction tube 1. On the other hand, the starting-material metal halide in the reservoir 5a, which is replenished through the replenishing tube 5c, is heated and vaporized. The vaporized halide is accompanied by an inert carrier gas such as nitrogen supplied from the carrier gas supply tube 5b to form a metal halide gas stream. This gas stream is introduced through the metal halide gas supply tube 6 into the reaction tube 1, flows upward in the same manner as the reducing gas, and contacts the reducing gas.

Because the metal halide gas stream is a vapor stream of a metal halide diluted with an inert gas, it has a far greater specific gravity than the $H_2$ reducing gas. In this case, the flow velocity of the reducing gas to be supplied is made faster than the velocity of the metal halide gas stream to obtain a difference in flow velocity between the two gas streams. Due to the differences in specific gravities and flow velocities of the gas streams, an unstable interface region 1a is formed at the interface which extends divergently inside of the reaction tube 1.

The unstable interface region 1a is a relatively thin contacting region between the two gas phases contacting each other in a laminar manner, and is microscopically a region wherein the two gases are mixed together by forming vortices in such a way that the gases engulf each other. In the vicinity of the opening of the $H_2$ reducing gas supply tube 3, there is formed a continuous layer of small eddies about 10 times as large as the produced particle nuclei. As the distance from the opening of the tube 3 increases, the small eddies are caused to gather together to form a continuous layer of larger vortices. In other words, the unstable interface region is not a simple mixture layer but a region having very high reactivity between the gases.

In this region, the starting material metal halide is reduced by $H_2$, the single metal separates out and forms the nuclei of metal powder. The nuclei have initially a very fine particle size as small as several tens of Å and are successively grown within the residence time in the reaction tube 1. The gas streams are as a whole in the form of a plug flow, and the residence time of the particles is substantially equal and short. Thus it is possible to obtain isotropic fine-powdery metal having substantially uniform particle size of, for example, of the order of 150 Å to 2,000 Å. In general, a larger residence time results in a larger particle size of powdery metal within this range.

The resulting fine powdery metal is collected by means of a collector 7 by separating it from the reducing gas, carrier gas and unreacted halide.

A horizontal flow channel 1b is provided if desired between the vertical reaction tube 1 and the collector 7, wherein additional heating can be conducted to carry out reduction of unreacted starting material gas and also to cause the produced particles to grow further.

Because the reaction of forming metal powder (reduction) in the process of the present invention is rapid, it is possible to consume substantially all the metal halide gas by supplying a sufficiently excess quantity of the reducing gas. But, fine metal powder is normally separated from unreacted materials by means of a collector. As the collector, a cyclone or an electrostatic collector can be used within a temperature range at which the unreacted metal halide material is stable as a gas. Alternatively, the unreacted metal halide is condensed and collected together with metal powder, and then the metal powder can be separated by using a suitable solvent.

The present process of the present invention comprises causing a metal halide gas and a reducing gas to contact each other in a laminar manner and forming an unstable interface region between the two gases. The case where the two gases flow vertically upward has been illustrated with reference to FIG. 1 (this can also be applied to FIG. 2 described below) as an example of the apparatus suitable for utilizing the difference in the specific gravity and flow velocity between the two gases. If it is possible to contact the two gas streams in a laminar manner by controlling the velocity of gas streams to a degree such that the difference in specific gravity between the two gases becomes negligible; the direction of the gas streams is not especially restricted. It may be possible at least to employ an upward flow, an obliquely upward flow, or a horizontal flow. When there is a marked difference in specific gravity between a metal halide gas and a reducing gas, it is very disadvantageous to employ a downward flow for contacting the two gases in a laminar manner. In this case, $H_2$ gas tends to go upward and the metal halide gas tends to go downward. Thus, the two gases are mixed poorly, and it is difficult to control the production and size distribution of the metal powder.

The preferred contact of the gases in a laminar manner can be achieved, as shown in FIG. 1 (and also in FIG. 2), by using a supply tube 3 located at the central axis of a reaction tube 1 as the tube for supplying a reducing gas which has a lower specific gravity. If the central supply tube 3 is used for a metal halide gas and $H_2$ gas is caused to flow along the outside thereof, the gas streams will be disordered due to a marked difference in specific gravity between the gases, and a simple interface for reaction cannot be maintained. Moreover, because of the large diffusion constant of hydrogen, the metal is liable to be deposited at the end of the halide supply nozzle or inside of the nozzle to clog the nozzle. In this case, however, a concentric double tube can be employed for the central supply tube 3 and an inert gas can be released as a sealing gas from the outer tube of the double tube, whereby the clogging of the inner nozzle tube can be prevented.

In the process of the present invention, an unstable interface region can be formed by causing the $H_2$ gas having a lower specific gravity to flow faster and a metal halide gas to flow slower in the same direction to cause contact between the two gases in a laminar manner.

Relative velocity of the two gases can be determined from the ratio of gas quantities, which depends on an equilibrium constant at the temperature of the reaction zone and the ratio of the metal halide gas to $H_2$ gas (i.e., hydrogen ratio) calculated from the desired conversion of, e.g., 99% and more specifically can be determined from the combination of the ratio of gas quantities and the cross-section areas of the gas supply tubes. The relative velocities thus depend upon the equilibrium state between $H_2$ gas and the kind of the metal halide to be reduced by the $H_2$ gas.

For example, in the case where iron powder is produced by a reduction reaction of ferrous chloride with $H_2$ gas at a temperature of 1,000° C. in the reaction zone 1 (the length of the zone may be about 100 to 1,000 mm, and the length of the unstable interface region 1*a* therein may be about 50 mm or shorter) by the use of an apparatus as shown in FIG. 1 (wherein the inner diameter of the reaction tube 1 is 30 mm, the inside diameter of the reducing gas supply tube 3 is 8 mm and the inner diameter of the supply tube 6 for the metal chloride gas and the carrier gas is 20 mm), the total flow rate of the chloride gas, carrier gas and reducing hydrogen gas is preferably in the range of 2 liter/minute to 100 liter/minute. Moreover, it is preferred that the quantity of the carrier gas (including an inert gas supplied from the tube 4 if desired) be 1 to 25 times by volume that of the chloride gas and the quantity of hydrogen be 2 to 200 times by volume the total quantity of the chloride gas and carrier gas.

As to the feed velocities of the respective gases in the reaction tube, a suitable value of the velocity of the mixture gas comprising the chloride gas and carrier gas which flows along the outside of the reducing gas supply tube 3 is about 2 to 15 m/minute, especially 6 to 10 m/minute, and that of the velocity of the hydrogen gas flowing in the tube 3 is 18 to 1,800 m/minute, especially 700 to 1,200 m/minute.

In the apparatus shown in FIG. 1, the temperature of the metal halide gas supply device 5 is set in the vicinity of the sublimation point or boiling point of the starting-material metal halide gas. Better results can be obtained by raising the temperature of the reaction zone (i.e., the portion constituting the unstable interface region 1*a*) higher than the temperature in the starting-material gas supply device 5, by means of an outside heater. In general, it is preferable to raise the temperature by approximately 50° to 200° C. For example, in the case of production of fine powdery metal of Fe, Co, Ni or Cu from the corresponding chloride, the suitable temperature range is 900° to 1,200° C.

In the process of the present invention, the quantity of vaporization of the metal halide is controlled by the heating temperature (i.e., the temperature at the vaporization zone) in the starting-material gas supply device 5 and the quantity of the carrier gas 5*b* blown toward the reservoir 5*a*. The particle size of the resulting particles can be controlled by the temperature at the reaction zone (i.e., the unstable interface region 1*a*) and the flow quantity of all gases (i.e., the residence time of the gases).

When the flow rate of the gas from the carrier gas tube 5*b* is increased, the vaporization quantity of the metal halide is increased, and the hydrogen ratio (i.e., the ratio of the quantity of hydrogen/the quantity of metal halide) is lowered. This operation also results in an increase in the total quantity of all gases, whereby the residence time in the reaction tube is shortened. As the flow rate of the gases is increased, the nuclei are generated in a very short period of time, and fine powder having a small average particle size is obtained. On the other hand, the conversion is decreased as the residence time is shortened.

In order to raise the conversion, an increase in the flow rate of the $H_2$ gas to an extent which will still ensure contact of the $H_2$ gas with the metal halide gas in a laminar manner may be considered. It is also effective to use multiple nozzles for the hydrogen gas for the purpose of enlarging the interfacial area with the metal halide gas, or to form a flow such that it will create spiral interfaces in the reaction tube.

In accordance with the process of the present invention, it is possible to produce a variety of fine powdery metal particles as described below. 1. Metal powder of ultrafine particles having uniform size can be obtained in a very stable state.

According to the present process, the product metal powder can have an amorphous metal structure or a non-equilibrium structure. For example, in the case of a readily reducible metal halide the metal element of which is known to be made amorphous by a rapid-cooling method or a thin-membrane method (i.e., Ni), the very marked generation of nuclei takes place in the present process, and the reaction is substantially completed in the gaseous reduction stage. Thus, the growth of the nuclei is controlled to give ultrafine particles of a metastable structure. This is generally possible when the reaction temperature is relatively high and the feed rates of the metal halide vapor and hydrogen are increased. 2. A variety of fine powdery alloys can be readily produced by using a plurality of metal halide gases instead of a single metal halide. For example, in the case of production of a Fe-Co alloy, the material gases (i.e., $FeCl_2$ and $CoCl_2$) are supplied from separate vaporization regions (e.g., 5 and 8 in FIG. 1) which have been controlled to temperatures in the vicinity of their boiling points or sublimation points, respectively. The quantity of hydrogen is set at 2 to 200 times the total equivalent quantity of the halide vapors. It is preferable that the hydrogen be preheated and the reaction zone be maintained at a temperature of 900° to 1,200° C.

In the case of production of a fine powdery Fe-alloy, fine powder of ferrite can be obtained by the use of $O_2$ gas and/or $H_2O$ gas instead of the $H_2$ gas, if desired.

Figure 2:
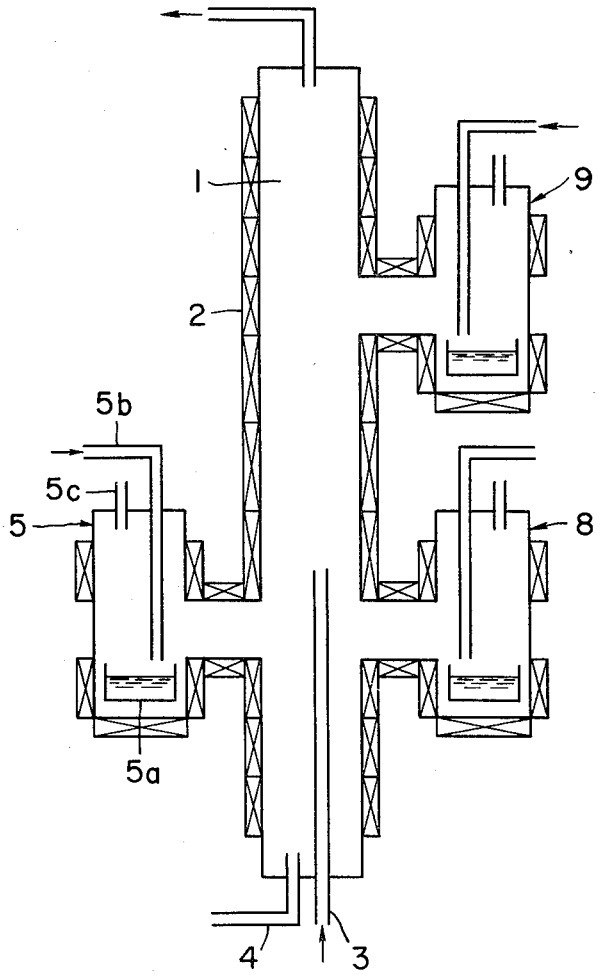

Incidentally, also in the production of the above mentioned alloy, the fine powdery alloy of an amorphous structure or a non-equilibrium structure can be obtained by controlling the reaction temperature and the feed rates of the metal halide gas and $H_2$ gas similarly as in the case of a single metal. 3. It is also possible to produce a coated alloy by coating the surfaces of fine metal particles with another metal. In this case, a similar metal halide gas supply device 9 is installed at an upper portion (a downstream portion) of the metal halide gas supply device 5 as shown in FIG. 2. Another metal halide gas thus introduced from the supply device 9 is reacted with the remaining $H_2$ gas and the resulting reduced metal is caused to deposit on the fine particles already produced in the gas stream. For example, Fe particles coated with Cu can be produced in this way. The deposition of metal onto the surfaces of such existing particles is performed far more readily than the generation of uniform nuclei in the reaction zone 1*a* of FIG. 1. Those parts in FIG. 2 which are the same as or equivalent to corresponding parts in FIG. 1 are designated by the same reference numerals. 4. In the above described coating process, the surfaces of fine metal particles can be coated with resins. For example, while fine metal particles are suspended in the gas, a plastic resin forming monomer such as vinyl chloride and styrene is introduced into the reaction tube from a supply device for the plastic monomer gas which has been installed in a downstream zone (a zone having a temperature which is higher than the boiling point of the monomer and at which substantially no thermal decomposition of the monomer occurs, for example, 50° to 200° C.). Thus, the monomer is polymerized on the surfaces of the fine particles by a high catalytic action of the metal surfaces freshly produced to produce a resin coating.

Objects of such resin coating are stabilization of metal particles in the air, facilitation of blending the particles into plastics, imparting of hydrophobic property to the particle surfaces, and formation of binder layer for metal powder compression molding.

In accordance with the process of the present invention, fine powder metal of any reducible metal species can be obtained as long as the halide of the metal can be reduced with hydrogen gas or the like. More specifically, the fine powder of at least the following metals can be obtained.

Cu, Au, Ag, Hg, W, Ni, Bi, Fe, Co, Sb, Cd, Sn, Ta, Nb, In, Cr, Zn, Tl, V, Pd, and Pt.

In a similar way, it is also possible to produce fine powder of the following semi-metals or non-metals by using corresponding halides instead of the metal halides as mentioned above.

B, C, Si, Ge, As, Se, Sb, Te.

The present invention will now be further described by way of examples of practice thereof.

EXAMPLE 1 (the case of a single metal)

In this example, ferrous chloride $FeCl_2$, cobalt I chloride $CoCl_2$, nickel chloride $NiCl_2$ and cuprous chloride CuCl, respectively, were used as the metal halide gas, and $H_2$ gas was used as the reducing gas. In the above-described reaction apparatus (FIG. 1), the inner diameter of the reaction tube 1 was 30 mm, and the effective length of the reaction tube 1 was 50 cm. The metal chloride gas was supplied at a rate of 0.1 mol/minute, and hydrogen gas at a rate of 0.5 mol/minute. Isotropic fine powdery metals having uniform particle sizes were obtained in very high yields, respectively, as shown in Table 1.

TABLE 1

| No. | Metal halide gas | Quantity supplied | Reducing gas | Quantity supplied | Reaction temperature | Particle size | Yield | Collected metal |
|---|---|---|---|---|---|---|---|---|
| 1 | $FeCl_2$ | 0.1 mol/min. | $H_2$ | 0.5 mol/min. | 1000° C. | 2000–6000 A | 70% | Fe powder |
| 2 | $CoCl_2$ | 0.1 mol/min. | $H_2$ | 0.5 mol/min. | 1000° C. | 1000–3000 A | 90% or more | Co powder |
| 3 | $NiCl_2$ | 0.1 mol/min. | $H_2$ | 0.5 mol/min. | 1000° C. | 800–2000 A | 95% or more | Ni powder |
| 4 | CuCl | 0.1 mol/min. | $H_2$ | 0.5 mol/min. | 1100° C. | 2000–6000 A | 85% | Cu powder |

Remarks:

In all cases of metal powders, the shape of the particles was substantially spherical but the crystal growth pattern thereof was not clear. The yield is expressed in terms of conversion (the rate of metallization) calculated from the Cl content in the collected materials. In general, when the supply rate of $H_2$ was decreased, the yield was lowered but the particle size was increased.

EXAMPLE 2 (the case of an alloy powder)

In the reaction apparatus described above (FIG. 1), the experiments were carried out substantially in the same way as in Example 1, except that the apparatus was equipped with plural supply devices (5, 8, . . . ) for metal halide gases, and the metal chloride gases shown in Table 2 were supplied in a predetermined ratio. Thus, fine powder of Fe-Co alloy, Fe-Ni alloy and Fe-Co-Ni alloy were obtained. The fine powdery alloys had uniform particle sizes and substable structures, which were characterized in that no peak was exhibited by X-ray diffraction.

TABLE 2

| No. | Mixing ratio (molar ratio) | Particle size | Yield | Collected metal |
|---|---|---|---|---|
| 1 | Fe:Co = 8:2 | 2000–6000 A | 85% | Fe—Co alloy |
| 2 | Fe:Ni = 8:2 | 2000–6000 A | 85% | Fe—Ni alloy |
| 3 | Fe:Ni:Co = 70:15:15 | 400–800 A | above 98% | Fe—Ni—Co alloy |

What is claimed is:

1. A process for producing fine powdery metal which comprises, in a generally elongated reaction tube at an elevated temperature, causing a reducing gas stream to flow along the axis of the reaction tube, and causing a mixture gas stream comprising a metal halide vapor and an inert carrier gas to flow in the same direction as but at a different velocity relative to the reducing gas stream so that the two streams contact each other in a laminar manner and form an unstable interface region therebetween, whereby the metal halide vapor is reduced by the reducing gas to form fine metal particles in the unstable interface region.

2. The process according to claim 1, in which the reducing gas is $H_2$ gas.

3. The process according to claim 1, in which the metal halide is a metal chloride.

4. The process according to claim 1, in which the reducing gas is supplied so that it flows in the center zone of the reaction tube, and the mixture gas stream is supplied so that it flows along the outer peripheral boundary of the reducing gas stream.

5. The process according to claim 1, in which the metal halide vapor is supplied along the central axis of the reaction tube, an inert sealing gas is supplied to flow along the outer peripheral boundary of the halide vapor stream, and the reducing gas is supplied to flow along the outer peripheral boundary of the sealing gas stream.

6. The process according to claim 1, in which the reducing gas and the mixture gas are caused to flow upward.

7. The process according to claim 1, in which the reducing gas stream is supplied at a velocity higher than that of the mixture gas stream.

8. The process according to claim 1, in which fine powdery alloy is produced by using two or more metal halide vapors.

9. The process according to claim 1, in which metal powder coated with another metal is obtained by using an excess amount of the reducing gas, mixing another metal halide gas stream with the reaction product stream containing produced fine metal particles in a downstream zone of the reduction reaction zone, and reducing said another metal halide with the remaining reducing gas in excess to cause deposition of the metal onto the already produced fine metal particles.

10. The process according to claim 1, in which a resin coating is formed on fine metal particles by mixing the vapor of a resin forming monomer with the reaction product stream containing produced metal particles in a downstream zone of the reduction zone and polymerizing the monomer on the metal particles.

* * * * *